United States Patent [19]

Huang

[11] Patent Number: 5,076,858

[45] Date of Patent: Dec. 31, 1991

[54] METHOD OF PROCESSING TITANIUM ALUMINUM ALLOYS MODIFIED BY CHROMIUM AND NIOBIUM

[75] Inventor: Shyh-Chin Huang, Latham, N.Y.

[73] Assignee: General Electric Company, Schenectady, N.Y.

[21] Appl. No.: 354,965

[22] Filed: May 22, 1989

[51] Int. Cl.[5] ..... C22F 1/018

[52] U.S. Cl. ..... 148/2; 148/11.5 F; 148/133; 420/427

[58] Field of Search ..... 148/2, 11.5 F, 133; 420/421

[56] References Cited

U.S. PATENT DOCUMENTS

| | | | |
|---|---|---|---|
| 4,661,316 | 4/1980 | Hashimoto et al. | 420/418 |
| 4,842,819 | 6/1989 | Huang et al. | 148/421 |

FOREIGN PATENT DOCUMENTS

| | | | |
|---|---|---|---|
| 0220571 | 7/1957 | Australia | 420/418 |
| 63-171862 | 7/1988 | Japan . | |

OTHER PUBLICATIONS

Izvestiya Akademii Nauk SSSR, Metally, No. 3 (1984), pp. 164–168–Transln. ("Deformation & Failure in Titanium Aluminide" (1985), pp. 157–161.

Martin PL/Lipsitt, HA/Nuhfer, NT/Williams, JC, "The Effects of Allowing on the Microstructure and Properties of $Ti_3Al$ and TiAl", Titanium 80 (published by The American Society of Metals, Warrendale, Pa.), vol. 2 (1980), pp. 1245–1254.

Tsujimoto, T, "Research, Development, and Prospects of TiAl Intermetallic Compound Alloys", Titanium & Zirconium, vol. 33, No. 3, 159 (Jul. 1985), pp. 1–19.

Lipsitt, HA, "Titanium Aluminides–An Overview", Mat. Res. Soc. Symposium Proc, vol. 39, Materials Research Society (1985), pp. 351–364.

Sastry et al., Met. Trans. 8A, "Fatigue Deformation of TiAl Base Alloys" (1977), pp. 299–308.

*Primary Examiner*—R. Dean

*Assistant Examiner*—Margery S. Phipps

*Attorney, Agent, or Firm*—Paul E. Rochford; James C. Davis, Jr.; James Magee, Jr.

[57] ABSTRACT

A method of preparing a TiAl base composition containing niobium and chromium according to the formula $Ti_{48}Al_{48}Cr_2Nb_2$ is taught. The composition is melted and cast. It is then homogenized at temperatures up to 1400° C. The cast and homogenized composition is enclosed in a restraining band, heated to forging temperature and forged. Following the forging, it is annealed and aged.

18 Claims, No Drawings

METHOD OF PROCESSING TITANIUM ALUMINUM ALLOYS MODIFIED BY CHROMIUM AND NIOBIUM

CROSS REFERENCE TO RELATED APPLICATIONS

The subject application relates to copending applications and U.S. Patents as follows: application Ser. No. 138,408, filed Dec. 28, 1987; Ser. Nos. 252,622, 253,649, filed Oct. 3, 1988; U.S. Pat. Nos. 4,836,983; 4,857,268; 4,842,819; 4,879,092; 4,902,474.

The texts of these related applications and patents are incorporated herein by reference.

BACKGROUND OF THE INVENTION

The present invention relates generally to alloys of titanium and aluminum. More particularly, it relates to the preparation of gamma alloys of titanium and aluminum which have been modified both with respect to stoichiometric ratio and with respect to chromium and niobium addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form, and a stoichiometric ratio of approximately one, is an intermetallic compound having a high modulus, a low density, a high thermal conductivity, favorable oxidation resistance, and good creep resistance. The gamma TiAl has the best modulus of any of the titanium alloys. Not only is the gamma TiAl modulus higher at higher temperature but the rate of decrease of the modulus with temperature increase is lower for TiAl than for the other titanium alloys. Moreover, the gamma TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of gamma TiAl which limits its actual application to such uses is a brittleness which is found to occur at room temperature. Also, the strength of the intermetallic compound at room temperature needs improvement before the gamma TiAl intermetallic compound can be exploited in structural component applications. Improvements of the TiAl intermetallic compound to enhance ductility and/or strength at room temperature are very highly desirable in order to permit use of the compositions at the higher temperature for which they are suitable.

With potential benefits of use at light weight and at high temperatures, what is most desired in the gamma TiAl compositions which are to be used is a combination of strength and ductility at room temperature. A minimum ductility of the order of one percent is acceptable for some applications of the metal composition but higher ductilities are much more desirable. A minimum room temperature strength for a composition to be generally useful is about 50 ksi or about 350 MPa. However, materials having this level of strength are of marginal utility and higher strengths are often preferred for some applications.

The stoichiometric ratio of gamma TiAl compounds can vary over a range without altering the crystal structure. The aluminum content can vary from about 50 to about 60 atom percent. The properties of gamma TiAl compositions are subject to very significant changes as a result of relatively small changes of one percent or more in the stoichiometric ratio of the titanium and aluminum ingredients. Also, the properties are similarly affected by the addition of relatively similar small amounts of ternary and quaternary elements as additives or as doping agents.

In a prior application, I disclosed that further improvements can be made in the gamma TiAl intermetallic compounds by incorporating therein a combination of additive elements so that the composition not only contains chromium as a ternary additive element but also contains niobium as a quaternary additive element.

Furthermore, I have disclosed that the composition including the quaternary additive element has a uniquely desirable combination of properties which include a desirably high ductility and a valuable oxidation resistance.

However, the methods by which this alloy could be prepared were limited. I have now discovered an improved and more economical method of preparing such an alloy.

PRIOR ART

There is extensive literature on the compositions of titanium aluminum including the $Ti_3Al$ intermetallic compound, the gamma TiAl intermetallic compounds and the $Ti_3Al$ intermetallic compound. A patent, U.S. Pat. No. 4,294,615, entitled "Titanium Alloys of the TiAl Type" contains an extensive discussion of the titanium aluminide type alloys including the gamma TiAl intermetallic compound. As is pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

The '615 patent also discloses in Table 2 alloy $T_2$A-112 which is a composition in atomic percent of Ti-45Al-5.0 Nb but the patent does not describe the composition as having any beneficial properties.

U.S. Pat. No. 4,661,316, to Hashimoto, teaches doping of TiAl with 0.1 to 5.0 weight percent of manganese as well as doping TiAl with combinations of other elements with manganese. The Hashimoto patent does not teach the doping of TiAl with chromium or with combinations of elements including chromium.

A number of technical publications dealing with the titanium aluminum compounds as well as with the characteristics of these compounds are as follows:

1. E. S. Bumps, H. D. Kessler, and M. Hansen, "Titanium-Aluminum System", *Journal of Metals,* June 1952, pp. 609–614, TRANSACTIONS AIME, Vol. 194.

2. H. R. Ogden, D. J. Maykuth, W. L. Finlay, and R. I. Jaffee, "Mechanical Properties of High Purity Ti-Al Alloys", *Journal of Metals,* February 1953, pp. 267–272, TRANSACTIONS AIME, Vol. 197.

3. Joseph B. McAndrew, and H. D. Kessler, "Ti-36 Pct Al as a Base for High Temperature Alloys", *Journal of Metals,* October 1956, pp. 1348–1353, TRANSACTIONS AIME, Vol. 206.

The McAndrew reference discloses work under way toward development of a TiAl intermetallic gamma alloy. In Table II, McAndrew reports alloys having ultimate tensile strength of between 33 and 49 ksi as adequate "where designed stresses would be well below this level". This statement appears immediately above Table II. In the paragraph above Table IV, McAndrew states that tantalum, silver and (niobium) columbium have been found useful alloys in inducing the formation of thin protective oxides on alloys exposed to temperatures of up to 1200° C. FIG. 4 of McAndrew is a plot of the depth of oxidation against the nominal weight percent of niobium exposed to still air at 1200° C. for 96 hours. Just above the summary on page 1353, a sample of titanium alloy containing 7 weight % columbium (niobium) is reported to have displayed a 50% higher rupture stress properties than the Ti-36% Al used for comparison.

BRIEF DESCRIPTION OF THE INVENTION

One object of the present invention is to provide a method of forming a gamma titanium aluminum intermetallic compound having improved ductility and related properties at room temperature.

Another object is to reduce the cost of improving the properties of titanium aluminum intermetallic compounds at low and intermediate temperatures.

Another object is to provide an improved method of forming an alloy of titanium and aluminum having improved properties and processability at low and intermediate temperatures.

Another object is to improve the preparation of an alloy having a combination of ductility and oxidation resistance in a TiAl base composition.

Yet another object is to reduce the cost of making improvements in a set of strength, ductility and oxidation resistance properties of a TiAl base alloy.

Other objects will be in part apparent, and in part pointed out, in the description which follows.

In one of its broader aspects, the objects of the present invention are achieved by providing a melt of the titanium aluminide doped with chromium and niobium and casting this melt into an ingot.

After casting, the ingot is homogenized at a temperature above the transus temperature for a time which depends on the homogenization temperature used and which is shorter at higher temperatures and longer at lower temperatures, for example, an ingot can be homogenized at or above about 1250° C. for about two hours. Preferably homogenization is done at about 1400° C. As used herein, the term "transus temperature" refers to the phase transition temperature above which the entire composition is in a single phase.

The homogenized ingot is then mechanically worked or deformed to change at least one original dimension by 10% or more.

According to one illustration practice, the homogenized ingot may be laterally jacketed for convenience with a band of metal adapted to restrain its outward deformation as the ingot is forged to a smaller vertical dimension about half its original vertical dimension.

The mechanical working is done when the ingot is heated to a temperature between about 900° C. and the incipient melting temperature.

In one illustration example, the jacket and ingot were heated to permit forging, as for example, to a temperature of about 975° C.

The heated and jacketed ingot may, in this case, be forged to about half its original thickness.

The forged ingot may then be annealed at a temperature below the transus temperature which temperature may illustratively be between about 1250° C. and 1350° C. for a time between one and ten hours based on the annealing temperature.

Following the annealing, the ingot may be aged as, for example, at a temperature between about 800° C. and about 1000° C. for about two to ten hours.

DETAILED DESCRIPTION OF THE INVENTION

It is well known, as is discussed above, that except for its brittleness and processing difficulties the intermetallic compound gamma TiAl would have many uses in industry because of its light weight, high strength at high temperatures, and relatively low cost. The composition would have many industrial uses today if it were not for this basic property defect of the material which has kept it from such uses for many years.

The present inventor found that the gamma TiAl compound could be substantially ductilized by the addition of a small amount of chromium. This finding is the subject of copending application Ser. No. 138,485, filed Dec. 28, 1987, now U.S. Pat. No. 4,842,817.

Further, the present inventor found that the ductilized composition could be remarkably improved in its oxidation resistance with no loss of ductility or strength by the addition of niobium in addition to the chromium. This later finding is the subject of copending application Ser. No. 201,984, filed June 3, 1988, now U.S. Pat. No. 4,879,092.

The inventor has now found that substantial further improvements in ductility can be made by low cost processing techniques and these techniques are the subject matter of the present invention.

To better understand the improvements in the properties of TiAl, a number of examples are presented and discussed here before the examples which deal with the novel processing practices of this invention.

EXAMPLES 1-3

Three individual melts were prepared to contain titanium and aluminum in various stoichiometric ratios approximating that of TiAl. The compositions, annealing temperatures and test results of tests made on the compositions are set forth in Table I.

For each example, the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also, care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and is extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060×0.120×1.0 in.) for four point bending tests at room temperature. The bending tests were carried out in a 4-point bending fixture having an inner span of 10 mm (0.4 in.) and an outer span of 20 mm (0.8 in.). The load-crosshead displacement curves were recorded. Based on the curves developed, the following properties are defined:

(1) Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements' results in many of the examples herein is between four point bending tests, and for all samples measured by this technique, such comparisons are quite valid in establishing the differences in strength properties resulting from differences in composition or in processing of the compositions.

2. Fracture strength is the stress to fracture.

3. Outer fiber strain is the quantity of 9.71hd, where "h" is the specimen thickness in inches, and "d" is the cross head displacement of fracture in inches. Metallurgically, the value calculated represents the amount of plastic deformation experienced at the outer surface of the bending specimen at the time of fracture.

The results are listed in the following Table I. Table I contains data on the properties of samples annealed at 1300° C.

TABLE I

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement It is evident from the data of this Table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due, in turn, to an extensive beta transformation at temperatures appreciably above 1350° C.

EXAMPLES 4-13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | * | 131 | 0 |
| 5 | 24 | $Ti_{52}Al_{46}Ag_2$ | 1200 | * | 114 | 0 |
| | | | 1300 | 92 | 117 | 0.5 |
| 6 | 25 | $Ti_{50}Al_{48}Cu_2$ | 1250 | * | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.2 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | * | 89 | 0 |
| | | | 1300 | * | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | * | 143 | 0 |
| | | | 1250 | 135 | 154 | 0.3 |
| | | | 1300 | 131 | 149 | 0.2 |
| 13 | 20 | $Ti_{49.5}Al_{49.5}Cr_1$ | + | + | + | + |

*See asterisk note to Table I
+ Material fractured during machining to prepare test specimens For Examples 4 and 5, heat treated at 1200° C., the yield strength was unmeasurable as the ductility was found to be essentially nil. For the specimen of Example 5 which was annealed at 1300° C., the ductility increased, but it was still undesirably low.

For Example 6, the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. The stoichiometric ratio or nonstoichiometric ratio has a strong influence on the test properties which are found from testing of from testing of different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent, then a composition $Ti_{48}A_{48}X_4$ will give an effective aluminum concentration of 48 atomic percent and an effective titanium concentration of 52 atomic percent.

If, by contrast, the X additive acts as an aluminum substituent, then the resultant composition will have an effective aluminum concentration of 52 percent and an effective titanium concentration of 48 atomic percent.

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition, there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a nonstoichiometric TiAl composition are highly unpredictable and that most test results are unsuccessful with respect to ductility or strength or to both.

EXAMPLES 14–17

A further parameter of the titanium aluminide alloys which include additives is that combinations of additives do not necessarily result in additive combinations of the individual advantages resulting from the individual and separate inclusion of the same additives.

Four additional TiAl based samples were prepared as described above with reference to Examples 1–3 to contain individual additions of vanadium, niobium, and tantalum as listed in Table III. These compositions are the optimum compositions reported in copending applications Ser. Nos. 138,476, 138,408, and 138,485, respectively, now U.S. Pat. Nos. 4,857,268, now abandoned, and now 4,842,817.

The fourth composition is a composition which combines the vanadium, niobium and tantalum into a single alloy designated in Table III to be alloy 48.

From Table III, it is evident that the individual additions vanadium, niobium and tantalum are able on an individual basis in Examples 14, 15, and 16 to each lend substantial improvement to the base TiAl alloy. However, these same additives when combined into a single combination alloy do not result in a combination of the individual improvements in an additive fashion. Quite the reverse is the case.

In the first place, the alloy 48 which was annealed at the 1350° C. temperature used in annealing the individual alloys was found to result in production of such a brittle material that it fractured during machining to prepare test specimens.

Secondly, the results which are obtained for the combined additive alloy annealed at 1250° C. are very inferior to those which are obtained for the separate alloys containing the individual additives.

In particular, with reference to the ductility, it is evident that the vanadium was very successful in substantially improving the ductility in the alloy 14 of Example 14. However, when the vanadium is combined with the other additives in alloy 48 of Example 17, the ductility improvement which might have been achieved is not achieved at all. In fact, the ductility of the base alloy is reduced to a value of 0.1.

Further, with reference to the oxidation resistance, the niobium additive of alloy 40 clearly shows a very substantial improvement in the 4 mg/cm$^2$ weight loss of alloy 40 as compared to the 31 mg/cm$^2$ weight loss of the base alloy. The test of oxidation, and the complementary test of oxidation resistance, involves heating a sample to be tested at a temperature of 982° C. for a period of 48 hours. After the sample has cooled, it is scraped to remove any oxide scale. By weighing the sample both before and after the heating and scraping, a weight difference can be determined. Weight loss is determined in mg/cm$^2$ by dividing the total weight loss in grams by the surface area of the specimen in square centimeters. This oxidation test is the one used for all measurements of oxidation or oxidation resistance as set forth in this application.

For the alloy 60 with the tantalum additive, the weight loss for a sample annealed at 1325° C. was determined to be 2 mg/cm$^2$ and this is again compared to the 31 mg/cm$^2$ weight loss for the base alloy. In other words, on an individual additive basis both niobium and tantalum additives were very effective in improving oxidation resistance of the base alloy.

However, as is evident from Example 17, results listed in Table III alloy 48 which contained all three additives, vanadium, niobium and tantalum in combination, the oxidation is increased to about double that of the base alloy. This is seven times greater than alloy 40 which contained the niobium additive alone and about 15 times greater than alloy 60 which contained the tantalum additive alone.

TABLE III

| Ex. No. | Gamma Alloy No. | Composit. (at. %) | Anneal Temp (°C.) | Yield Strength (ksi) | Fracture Strength (ksi) | Outer Fiber Strain (%) | Weight Loss After 48 hours @98° C. (mg/cm$^2$) |
|---|---|---|---|---|---|---|---|
| 2 | 12 | $Ti_{52}Al_{48}$ | 1250 | 130 | 180 | 1.1 | * |
| | | | 1300 | 98 | 128 | 0.9 | * |
| | | | 1350 | 88 | 122 | 0.9 | 31 |
| 14 | 14 | $Ti_{49}Al_{48}V_3$ | 1300 | 94 | 145 | 1.6 | 27 |
| | | | 1350 | 84 | 136 | 1.5 | * |
| 15 | 40 | $Ti_{50}Al_{46}Nb_4$ | 1250 | 136 | 167 | 0.5 | * |
| | | | 1300 | 124 | 176 | 1.0 | 4 |
| | | | 1350 | 86 | 100 | 0.1 | * |
| 16 | 60 | $Ti_{48}Al_{48}Ta_4$ | 1250 | 120 | 147 | 1.1 | * |
| | | | 1300 | 106 | 141 | 1.3 | * |
| | | | 1325 | * | * | * | * |
| | | | 1325 | * | * | * | 2 |
| | | | 1350 | 97 | 137 | 1.5 | * |
| | | | 1400 | 72 | 92 | 0.2 | * |
| 17 | 48 | $Ti_{49}Al_{45}V_2Nb_2Ta_2$ | 1250 | 106 | 107 | 0.1 | 60 |
| | | | 1350 | + | + | + | * |

*Not measured
+ Material fractured during machining to prepare test specimen

The individual advantages or disadvantages which result from the use of individual additives repeat reliably as these additives are used individually over and over again. However, when additives are used in combination the effect of an additive in the combination in a base alloy can be quite different from the effect of the additive when used individually and separately in the same base alloy. Thus, it has been discovered that addition of vanadium is beneficial to the ductility of titanium aluminum compositions and this is disclosed and discussed in the copending application for patent Ser. No. 138,476. Further, one of the additives which has been found to be beneficial to the strength of the TiAl base and which is described in copending application Ser. No. 138,408, filed Dec. 28, 1987, as discussed above, is the additive niobium. In addition, it has been shown by the McAndrew paper discussed above that the individual addition of niobium additive to TiAl base alloy can improve oxidation resistance. Similarly, the individual addition of tantalum is taught by McAndrew as assisting in improving oxidation resistance. Furthermore, in copending application Ser. No. 138,485, it is disclosed that addition of tantalum results in improvements in ductility.

In other words, it has been found that vanadium can individually contribute advantageous ductility improvements to titanium aluminum compound and that tantalum can individually contribute to ductility and oxidation improvements. It has been found separately that niobium additives can contribute beneficially to the strength and oxidation resistance properties of titanium aluminum. However, the Applicant has found, as is indicated from this Example 17, that when vanadium, tantalum, and niobium are used together and are combined as additives in an alloy composition, the alloy composition is not benefited by the additions but rather there is a net decrease or loss in properties of the TiAl which contains the niobium, the tantalum, and the vanadium additives. This is evident from Table III.

From this, it is evident that, while it may seem that if two or more additive elements individually improve TiAl that their use together should render further improvements to the TiAl, it is found, nevertheless, that such additions are highly unpredictable and that, in fact, for the combined additions of vanadium, niobium and tantalum a net loss of properties result from the combined use of the combined additives together rather than resulting in some combined beneficial overall gain of properties.

From Table III above, it is evident that the alloy containing the combination of the vanadium, niobium and tantalum additions has far worse oxidation resistance than the base TiAl 12 alloy of Example 2. Here, again, the combined inclusion of additives which improve a property on a separate and individual basis have been found to result in a net loss in the very property which is improved when the additives are included on a separate and individual basis.

EXAMPLES 18 thru 23

Six additional samples were prepared as described above with reference to Examples 1–3 to contain chromium modified titanium aluminide having compositions respectively as listed in Table IV.

Table IV summarizes the bend test results on all of the alloys, both standard and modified, under the various heat treatment conditions deemed relevant.

TABLE IV

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 18 | 38 | $Ti_{52}Al_{46}Cr_2$ | 1250 | 113 | 170 | 1.6 |
| | | | 1300 | 91 | 127 | 0.4 |
| | | | 1350 | 71 | 89 | 0.2 |
| 19 | 80 | $Ti_{50}Al_{48}Cr_2$ | 1250 | 97 | 131 | 1.2 |
| | | | 1300 | 89 | 135 | 1.5 |
| | | | 1350 | 93 | 108 | 0.2 |
| 20 | 87 | $Ti_{48}Al_{50}Cr_2$ | 1250 | 108 | 122 | 0.4 |
| | | | 1300 | 106 | 121 | 0.3 |
| | | | 1350 | 100 | 125 | 0.7 |
| 21 | 49 | $Ti_{50}Al_{46}Cr_4$ | 1250 | 104 | 107 | 0.1 |
| | | | 1300 | 90 | 116 | 0.3 |
| 22 | 79 | $Ti_{48}Al_{48}Cr_4$ | 1250 | 122 | 142 | 0.3 |
| | | | 1300 | 111 | 135 | 0.4 |
| | | | 1350 | 61 | 74 | 0.2 |
| 23 | 88 | $Ti_{46}Al_{50}Cr_4$ | 1250 | 128 | 139 | 0.2 |
| | | | 1300 | 122 | 133 | 0.2 |
| | | | 1350 | 113 | 131 | 0.3 |

The results listed in Table IV offer further evidence of the criticality of a combination of factors in determining the effects of alloying additions or doping additions on the properties imparted to a base alloy. For example, the alloy 80 shows a good set of properties for a 2 atomic percent addition of chromium. One might expect further improvement from further chromium addition. However, the addition of 4 atomic percent chromium to alloys having three different TiAl atomic ratios demonstrates that the increase in concentration of an additive found to be beneficial at lower concentrations does not follow the simple reasoning that if some is good, more must be better. And, in fact, for the chromium additive just the opposite is true and demonstrates that where some is good, more is bad.

As is evident from Table IV, each of the alloys 49, 79 and 88, which contain "more" (4 atomic percent) chromium shows inferior strength and also inferior outer fiber strain (ductility) compared with the base alloy.

By contrast, alloy 38 of Example 18 contains 2 atomic percent of additive and shows only slightly reduced strength but greatly improved ductility. Also, it can be observed that the measured outer fiber strain of alloy 38 varied significantly with the heat treatment conditions. A remarkable increase in the outer fiber strain was achieved by annealing at 1250° C. Reduced strain was observed when annealing at higher temperatures. Similar improvements were observed for alloy 80 which also contained only 2 atomic percent of additive although the annealing temperature was 1300° C. for the highest ductility achieved.

For Example 20, alloy 87 employed the level of 2 atomic percent of chromium but the concentration of aluminum is increased to 50 atomic percent. The higher aluminum concentration leads to a small reduction in the ductility from the ductility measured for the two percent chromium compositions with aluminum in the 46 to 48 atomic percent range. For alloy 87, the optimum heat treatment temperature was found to be about 1350° C.

From Examples 18, 19 and 20, which each contained 2 atomic percent additive, it was observed that the optimum annealing temperature increased with increasing aluminum concentration.

From this data it was determined that alloy 38 which has been heat treated at 1250° C., had the best combination of room temperature properties. Note that the optimum annealing temperature for alloy 38 with 46 at. % aluminum was 1250° C. but the optimum for alloy 80 with 48 at. % aluminum was 1300° C.

These remarkable increases in the ductility of alloy 38 on treatment at 1250° C. and of alloy 80 on heat treatment at 1300° C. were unexpected as is explained in the copending application for Ser. No. 138,485, filed Dec. 28, 1987.

What is clear from the data contained in Table IV is that the modification of TiAl compositions to improve the properties of the compositions is a very complex and unpredictable undertaking. For example, it is evident that chromium at 2 atomic percent level does very substantially increase the ductility of the composition where the atomic ratio of TiAl is in an appropriate range and where the temperature of annealing of the composition is in an appropriate range for the chromium additions. It is also clear from the data of Table IV that, although one might expect greater effect in improving properties by increasing the level of additive, just the reverse is the case because the increase in ductility which is achieved at the 2 atomic percent level is reversed and lost when the chromium is increased to the 4 atomic percent level. Further, it is clear that the 4 percent level is not effective in improving the TiAl properties even though a substantial variation is made in the atomic ratio of the titanium to the aluminum and a substantial range of annealing temperatures is employed in studying the testing the change in properties which attend the addition of the higher concentration of the additive.

EXAMPLE 24

Samples of alloys were prepared which had a composition as follows:

$Ti_{52}Al_{46}Cr_2$.

Test samples of the alloy were prepared by two different preparation modes or methods and the properties of each sample were measured by tensile testing. The methods used and results obtained are listed in Table V immediately below.

TABLE V

| Ex. No. | Alloy No. | Composition (at. %) | Processing Method | Anneal Temp (°C.) | Yield Strength (ksi) | Tensile Strength (ksi) | Plastic Elongation (%) |
|---|---|---|---|---|---|---|---|
| 18 | 38 | $Ti_{52}Al_{46}Cr_2$ | Rapid Solidification | 1250 | 93 | 108 | 1.5 |
| 24 | 38 | $Ti_{52}Al_{46}Cr_2$ | Ingot Metallurgy | 1225 | 77 | 99 | 3.5 |
| | | | | 1250 | 74 | 99 | 3.8 |
| | | | | 1275 | 74 | 97 | 2.6 |

In Table V, the results are listed for alloy samples 38 which were prepared according to two Examples, 18 and 24, which employed two different and distinct alloy preparation methods in order to form the alloy of the respective examples. In addition, test methods were employed for the metal specimens prepared from the alloy 38 of Example 18 and separately for alloy 38 of Example 24 which are different from the test methods used for the specimens of the previous examples.

Turning now first to Example 18, the alloy of this example was prepared by the method set forth above with reference to Examples 1–3. This is a rapid solidification and consolidation method. In addition for Example 18, the testing was not done according to the 4 point bending test which is used for all of the other data reported in the tables above and particularly for Example 18 of Table IV above. Rather the testing method employed was a more conventional tensile testing according to which a metal sample is prepared as tensile bars and subjected to a pulling tensile test until the metal elongates and eventually breaks. For example, again with reference to Example 18 of Table V, the alloy 38 was prepared into tensile bars and the tensile bars were subjected to a tensile force until there was a yield or extension of the bar at 93 ksi.

The yield strength in ksi of Example 18 of Table V, measured by a tensile bar, compares to the yield strength in ksi of Example 18 of Table IV which was measured by the 4 point bending test. In general, in metallurgical practice, the yield strength determined by tensile bar elongation is a more generally accepted measure for engineering purposes.

Similarly, the tensile strength in ksi of 108 represents the strength at which the tensile bar of Example 18 of Table V broke as a result of the pulling. This measure is referenced to the fracture strength in ksi for Example 18 in Table V. It is evident that the two different tests result in two different measures for all of the data.

With regard next to the plastic elongation, here again there is a correlation between the results which are determined by 4 point bending tests as set forth in Table IV above for Example 18 and the plastic elongation in percent set forth in the last column of Table V for Example 18.

Referring again now to Table V, the Example 24 is indicated under the heading "Processing Method" to be prepared by ingot metallurgy. As used herein, the term "ingot metallurgy" refers to a melting of the ingredients of the alloy 38 in the proportions set forth in Table V and corresponding exactly to the proportions set forth for Example 18. In other words, the composition of alloy 38 for both Example 18 and for Example 24 are identically the same. The difference between the two examples is that the alloy of Example 18 was prepared by rapid solidification and the alloy of Example 24 was prepared by ingot metallurgy. Again, the ingot metallurgy involves a melting of the ingredients and solidification of the ingredients into an ingot. The rapid solidification method involves the formation of a ribbon by the melt spinning method followed by the consolidation of the ribbon into a fully dense coherent metal sample.

In the ingot melting procedure of Example 24 the ingot is prepared to a dimension of about 2" in diameter and about ½" thick in the approximate shape of a hockey puck. Following the melting and solidification of the hockey puck-shaped ingot, the ingot was enclosed within a steel annulus having a wall thickness of about ½" and having a vertical thickness which matched identically that of the hockey puck-shaped ingot. Before being enclosed within the retaining ring the hockey puck ingot was homogenized by being heated to 1250° C. for two hours. The assembly of the hockey puck and containing ring were heated to a temperature of about 975° C. The heated sample and containing ring were forged to a thickness of approximately half that of the original thickness.

Following the forging and cooling of the specimen, tensile specimens were prepared corresponding to the tensile specimens prepared for Example 18. These tensile specimens were subjected to the same conventional tensile testing as was employed in Example 18 and the yield strength, tensile strength and plastic elongation measurements resulting from these tests are listed in Table V for Example 24. As is evident from the Table V results, the individual test samples were subjected to different annealing temperatures prior to performing the actual tensile tests.

For Example 18 of Table V, the annealing temperature employed on the tensile test specimen was 1250° C. For the three samples of the alloy 38 of Example 24 of Table V, the samples were individually annealed at the three different temperatures listed in Table V and specifically 1225° C., 1250° C., and 1275° C. Following this annealing treatment for approximately two hours, the samples were subjected to conventional tensile testing and the results again are listed in Table 24 for the three separately treated tensile test specimens.

Turning now again to the test results which are listed in Table V, it is evident that the yield strengths determined for the rapidly solidified alloy are somewhat higher than those which are determined for the ingot processed metal specimens. Also, it is evident that the plastic elongation of the samples prepared through the ingot metallurgy route have generally higher ductility than those which are prepared by the rapid solidification route. The results listed for Example 24 demonstrate that although the yield strength measurements are somewhat lower than those of Example 18 they are fully adequate for many applications in aircraft engines and in other industrial uses. However, based on the ductility measurements and the results of the measurements as listed in Table 24 the gain in ductility makes the alloy 38 as prepared through the ingot metallurgy route a very desirable and unique alloy for those applications which require a higher ductility. Generally speaking, it is well-known that processing by ingot metallurgy is far less expensive than processing through melt spinning or rapid solidification inasmuch as there is no need for the expensive melt spinning step itself nor for the consolidation step which must follow the melt spinning.

EXAMPLE 25

Samples of an alloy containing both chromium additive and niobium additive were prepared as disclosed above with reference to Examples 1-3. Tests were conducted on the samples and the results are listed in Table VI immediately below. The preparation of the alloy of Example 25, and the testing of the alloy, is described and discussed in copending application Ser. No. 201,984, filed June 3, 1988.

TABLE VI*

| Ex. No. | Alloy No. | Composit. (at. %) | Anneal Temp (°C.) | Yield Strength (ksi) | Tensile Strength (ksi) | Plastic Elongtn (%) | Weight Loss After 48 hours @98° C. (mg/cm$^2$) |
|---|---|---|---|---|---|---|---|
| 2 | 12 | $Ti_{52}Al_{48}$ | 1300 | 77 | 92 | 2.1 | + |
| | | | 1350 | + | + | + | 31 |
| 15 | 40 | $Ti_{50}Al_{46}Nb_4$ | 1300 | 87 | 100 | 1.6 | 4 |
| 19 | 80 | $Ti_{50}Al_{48}Cr_2$ | 1275 | + | + | + | 47 |
| | | | 1300 | 75 | 97 | 2.8 | + |
| 25 | 81 | $Ti_{48}Al_{48}Cr_2Nb_2$ | 1275 | 82 | 99 | 3.1 | 4 |
| | | | 1300 | 78 | 95 | 2.4 | + |
| | | | 1325 | 73 | 93 | 2.6 | + |

+ Not measured
*The data in this Table is based on conventional tensile testing rather than on the four-point bending as described above It is known from Example 17 in Table III above that the addition of more than one additive elements each of which is effective individually in improving and in contributing to an improvement of different properties of the TiAl compositions, that nonetheless when more than one additive is employed in concert and combination, as is done in Example 17, the result is essentially negative in that the combined addition results in a decrease in desired overall properties rather than an increase. Accordingly, it was pointed out in copending application Ser. No. 201,984 that it is very surprising to find that by the addition of two elements and specifically chromium and niobium to bring the additive level of the TiAl to the 4 atomic percent level, and employing a combination of two differently acting additives, that a substantial further increase in the desirable overall property of the alloy of the TiAl composition is achieved. In fact, the highest ductility levels achieved in all of the tests on materials prepared by the Rapid Solidification Technique are those listed in the application which are achieved through use of the combined chromium and niobium additive combination.

As also pointed out in copending application Ser. No. 201,984, further set of tests were done in connection with the alloys and these tests concern the oxidation resistance of the alloys. In this test, the weight loss after 48 hours of heating at 982° C. in air were measured. The measurement was made in milligrams per square centimeter of surface of the test specimen. The results of the tests are also listed in Table VI. Accordingly, what was found in relation to the chromium and niobium containing alloy was that it has a very desirable level of ductility and the highest achieved together with a very substantial improvement and level of oxidation resistance.

EXAMPLE 26

The alloy described in Example 25 was prepared by rapid solidification. By contrast, the alloy of this example was prepared by ingot metallurgy in a manner similar to that described in Example 24 above.

The specific preparation method is important in achieving an improvement in properties over the properties of the composition as described in copending application Ser. No. 201,984, filed June 3, 1988.

The proportions of the ingredient of this alloy are as follows:

$$Ti_{48}Al_{48}Cr_2Nb_2.$$

The ingredients were melted together and then solidified into two ingots about 2 inches in diameter and about 0.5 inches thick. The melts for these ingots were prepared by electro-arc melting in a copper hearth.

The first of the two ingots was homogenized for 2 hours at 1250° C. and the second was homogenized at 1400° C. for two hours.

After homogenization, each ingot was individually fitted to a close fitting annular steel ring having a wall thickness of about ½ inch. Each of the ingots and its containing ring was heated to 975° C. and was then forged to a thickness about half that of the original thickness.

Both forged samples were then annealed at temperatures between 1250° C. and 1350° C. for two hours. Following the annealing, the forged samples were aged at 1000° C. for two hours. After the aging, the sample ingots were machined into tensile bars for tensile tests at room temperature.

Table VII below summarizes the results of the room temperature tensile tests.

TABLE VII*

Room Temperature Tensile Properties of Cast-and-Forged $Ti_{48}Al_{48}Cr_2Nb_2$

| Ingot Homogenization Temperature (°C.) | Tensile Specimen Heat Treatment Temp. (°C.) | Yield Strength (ksi) | Fracture Strength (ksi) | Plastic Elongation (%) |
|---|---|---|---|---|
| 1250 | 1275 | 61 | 70 | 1.4 |
| | 1300 | 67 | 74 | 1.5 |
| | 1325 | 62 | 76 | 2.1 |
| | 1350 | 65 | 61 | 1.3 |
| 1400 | 1275 | 64 | 77 | 2.7 |
| | 1300 | 63 | 77 | 2.8 |
| | 1325 | 60 | 76 | 2.9 |

*The data in this Table is based on conventional tensile testing rather than on the four-point bending as described in Examples 1-23 above From the data included in Table VI above and in Table VII here, it is evident that it has been demonstrated experimentally that a strong ductile TiAl base alloy having high resistance to oxidation has been prepared by cast and wrought metallurgy techniques.

The yield strengths are in the 60 to 67 ksi range and it is noteworthy that these yield strengths are quite independent of homogenization and heat treatment temperatures be strongly dependent on the homogenization temperatures used. Thus, when the 1250° C. homogenization temperature is used, the ductilities measured range from 1.3 to 2.1% depending on the heat treatment temperature.

However, when the heat treatment is performed at 1400° C., the ductilities achieved in the samples are at the higher values of 2.7 to 2.9%. These ductilities are significantly higher and, furthermore, are significantly more consistent than those found from measurements of the materials homogenized at the lower temperature.

These tests demonstrate that the ductility of a $Ti_{48}Al_{48}Cr_2Nb_2$ composition prepared by cast-and-forged metallurgy techniques are greatly improved by homogenization at 1400° C.

The foregoing example demonstrates the preparation of a composition having a unique combination of ductility, strength and oxidation resistance. Moreover, the preparation is by a low cost ingot metallurgy method as distinct from the more expensive melt spinning method used in Example 25.

The method is unique to the composition doped with the combination of chromium and niobium. The concentration ranges of the chromium and niobium for which the subject method will produce advantageous results is as follows:

$Ti_{52-42}Al_{46-50}Cr_{1-3}Nb_{1-5}$.

The homogenization of the ingot prior to thickness reduction is preferably carried out at a temperature of about 1400° C. but homogenization at temperatures above the transus temperature in practicing the present method is feasible. It will be realized that the transus temperature will vary depending on the stoichiometric ratio of the titanium and the aluminum and on specific concentrations of the chromium and niobium additives. For this reason, it is advisable to first determine the transus temperature of a particular composition and to use this value in carrying out the present invention.

Homogenization times may vary inversely with the temperature employed but shorter times of the order of one to three hours are preferred.

Following the homogenization and enclosing of the ingot, the assembly of ingot and containing ring are heated to 975° C. prior to the reduction in thickness through forging. Successful forging can be accomplished without any containing ring and with samples heated to temperatures between about 900° C. and the incipient melting temperature. Temperatures above the incipient melting point should be avoided.

The reduction in thickness step is not limited to a reduction to one half the original thickness. Reductions of from about 10% and higher produce useful results in practicing the present invention. A reduction above 50% is preferred.

Annealing, following the thickness reduction, can be carried out over a range of temperatures from about 1250° C. to the transus temperature, and preferably from about 1250° C. to about 1350° C., and over a range of times from about one hour to about 10 hours, and preferably in the shorter time ranges of about one to three hours. Samples annealed at higher temperatures are preferably annealed for shorter times to achieve essentially the same effective anneal.

Aging may be carried out after the annealing. Aging is usually done at a lower temperature than the annealing and for a short time in the order of one or a few hours. Aging at 1000° C. for one hour is a typical aging treatment. Aging is helpful but not essential to practice of the present invention.

What is claimed and sought to be protected by Letters Patent of the United States is as follows:

1. The method of processing a TiAl base alloy to impart desirable strength and ductility properties which comprises, providing a melt of the TiAl base alloy having the formula $Ti_{52-42}Al_{46-50}Cr_{1-3}Nb_{1-5}$, casting the melt to form an ingot, homogenizing the ingot at a temperature between 1250° C. and 1400° C. for one to three hours, heating the ingot at temperature between 900° C. and the incipient melting temperature, forging the ingot to reduce the ingot by at least 10% of its original thickness, and.

annealing the forged ingot at temperatures between 1250° C. and the transus temperature for one to three hours.

2. The method of claim 1, in which the formula is:

$Ti_{51-43}Al_{46-50}Cr_2Nb_{1-5}$.

3. The method of claim 1, in which the formula is:

$Ti_{50-46}Al_{46-50}Cr_2Nb_2$.

4. The method of claim 1, in which the homogenization temperature is between 1300° C. and 1400° C.

5. The method of claim 1, in which the homogenization temperature is between 1350° C. and 1400° C.

6. The method of claim 1, in which the homogenization temperature is 1400° C.

7. The method of processing a TiAl base alloy to impart desirable strength and ductility properties which providing a melt of the TiAl base alloy having the formula $Ti_{51-42}Al_{46-50}Cr_{1-3}Nb_{1-5}$, casting the melt to form an ingot, homogenizing the ingot at a temperature between 1250° C. and 1400° C. for one to three hours, heating the ingot at temperatures between 900° C. and the incipient melting temperature, forging the ingot to reduce the ingot by at least 10% of its original thickness, annealing the forged ingot at temperatures between 1250° C. and the transus temperature for one to three hours, aging the annealed ingot at temperatures between 800° C. and about 1000° C. for about two to ten hours.

8. The method of claim 7, in which the formula is:

$Ti_{51-43}Al_{46-50}Cr_2Nb_{1-5}$.

9. The method of claim 7, in which the formula is:

$Ti_{50-46}Al_{46-50}Cr_2Nb_2$.

10. The method of claim 7, in which the homogenization temperature is between 1300° C. and 1400° C.

11. The method of claim 7, in which the homogenization temperature is between 1350° C. and 1400° C.

12. The method of claim 7, in which the homogenization temperature is 1400° C.

13. The method of processing a TiAl base alloy to impart desirable strength and ductility properties which comprises, providing a melt of the TiAl base alloy having the formula $Ti_{51-42}Al_{46-50}Cr_{1-3}Nb_{1-5}$, casting the melt to form an ingot, homogenizing the ingot at a temperature between 1250° C. and 1400° C. for one to three hours, heating the ingot to 950° to 1300° C., forging the ingot to reduce the ingot by at least 50% of its original thickness, and annealing the forged ingot at temperatures between 1250° C. and the transus temperature for one to three hours.

14. The method of claim 13, in which the formula is:

$Ti_{51-43}Al_{46-50}Cr_2Nb_{1-5}$.

15. The method of claim 13, in which the formula is:

$Ti_{50-46}Al_{46-50}Cr_2Nb_2$.

16. The method of claim 13, in which the homogenization temperature is between 1300° C. and 1400° C.

17. The method of claim 13, in which the homogenization temperature is between 1350° C. and 1400° C.

18. The method of claim 13, in which the homogenization temperature is 1400° C.

* * * * *